United States Patent [19]

Oberleitner et al.

[11] 4,449,730

[45] May 22, 1984

[54] FRONT JAW FOR A SAFETY SKI BINDING

[75] Inventors: Gerhard Oberleitner; Theodor Nitschko, both of Vienna, Austria

[73] Assignee: TMC Corporation, Baar, Switzerland

[21] Appl. No.: 315,814

[22] Filed: Oct. 28, 1981

[30] Foreign Application Priority Data

Nov. 4, 1980 [AT] Austria ..... 5410/80

[51] Int. Cl.[3] ..... A63C 9/08

[52] U.S. Cl. ..... 280/625; 280/630; 280/634

[58] Field of Search ..... 280/625, 629, 630, 634

[56] References Cited

U.S. PATENT DOCUMENTS

| | | | |
|---|---|---|---|
| 4,088,343 | 5/1978 | Krob | 280/625 |
| 4,166,636 | 9/1979 | Svoboda | 280/625 |
| 4,170,371 | 10/1979 | Weigl | 280/625 |

*Primary Examiner*—Joseph F. Peters, Jr.
*Assistant Examiner*—Joseph McCarthy
*Attorney, Agent, or Firm*—Flynn, Thiel, Boutell & Tanis

[57] ABSTRACT

The invention relates to a jaw, in particular a front jaw for safety ski bindings including a support member having at least two bolts therein symmetrically arranged with respect to a longitudinal center plane of the jaw and oriented perpendicularly with respect to the upper side of the ski. About each bolt is pivotally supported a two-arm sole holder, one arm of which engages the sole of a ski shoe and the other arm of which extends laterally inwardly toward the longitudinal axis of the ski and engages a part which is movable in the longitudinal direction of the ski against the force of a spring. The spring is supported at its one end on the support member and at its other end on an abutment which can be adjusted by means of an adjusting screw.

14 Claims, 3 Drawing Figures

FRONT JAW FOR A SAFETY SKI BINDING

FIELD OF THE INVENTION

This invention relates to a ski binding and, more particularly, to a front jaw having structure thereon for reducing the frictional forces during a release operation.

BACKGROUND OF THE INVENTION

A jaw of the abovementioned type is described for example in Austrian Pat. No. 315 041 (corresponds to U.S. Pat. No. 3,822,071). The movable part of this design is constructed in the form of a rack having a body of revolution with at least one annular groove therein and is movably supported in the longitudinal center plane of the jaw between the bolts of the sole holders with extensions on the sole holders being received in the grooves of the rack. If a lateral force acts onto a clamped ski shoe, both sole holders swing outwardly and the rack is hereby pulled backwardly by the extensions against the force of the spring. An important disadvantage of this conventional design is that high frictional forces develop between the ski shoe sole and the sole holder during a load on the sole holder in a direction toward the tip of the ski, as will occur for example during a fall of the skier forwardly, which frictional forces delay or prevent a release of the jaw and can result in injury (fractures) to the skier.

Therefore, the purpose of the invention is to bring help here and to provide a jaw of the abovementioned type in such a manner that said jaw compensates for the frictional forces which occur during the application of a force which acts onto the jaw in a direction toward the tip of the ski and wherein the release force is to be maintained constant.

The set purpose is inventively attained by a support member being movably guided in the longitudinal direction of the ski, and the arms of the two sole holders, which arms extend in a direction toward the longitudinal axis of the ski being supported ski-fixed. Through these measures, a compensation of the additional frictional forces which occur between the sole holders and the ski shoe during a forward fall of the skier is assured. The ski shoe moves the support member in direction toward the tip of the ski, the ski-fixed supported sole holder arms swing forwardly during a simultaneous compression of the spring and facilitate an easier release of the ski shoe compared with common jaw systems while maintaining the lateral release force constant. Also the inventive measures prevent a deformation of the ski shoe during a bending of the ski, as it occurs for example during skiing through a depression.

To support the sole holder arms, a support part is inventively provided which is moved onto a ski-fixed elongated guide rail extending longitudinally of the ski, which support part is supported at one end on at least one stop pin on the guide rail and at the other end by means of two support arms which extend substantially parallel with respect to the upper side of the ski and symmetrically with respect to the longitudinal axis of the ski and engage the sole holder arms. The structural part which is provided for supporting the sole holder arms is thus designed very simply. Further, it can easily be arranged in the jaw and requires little or no structural changes to existing jaw systems.

An important advantage of the invention is in the location of the points of engagement of the support arms of the support part on the arms of the sole holders relative to the longitudinal axis of the ski for determining the degree of translation of a power component, which acts in a direction toward the tip of the ski onto the sole holder, onto the spring force. The degree of translation of a force, which force acts in a direction toward the tip of the ski onto the sole holder, onto the spring force can thus be freely chosen by the designer in correspondence with the respectively desired spring.

A further inventive development is characterized by the support member having a support plate which is movable on a ski-fixed guide rail and an upstanding wall segment thereon which extends substantially perpendicularly with respect to the upper side of the ski. The upstanding wall segment supports an end of the spring remote from an adjustable abutment and has on both sides of the longitudinal axis of the ski a recess receiving therethrough one of the support arms of the support part. These measures contribute to the compact design of the jaw.

A further characteristic of the invention is in the support member being movably guided on the guide rail in an area which corresponds with the spacing of the upstanding wall segment on the support member from the support part, which upstanding wall segment faces the support part. This measure prevents a movement of the support member toward the tip of the ski beyond acceptable limits. Further, a lateral holding force and thus a lateral release force for a ski shoe which is inserted into the jaw is assured on the sole holders even when the force which acts onto the sole holders in a direction toward the top of the ski is relatively large. A further preferable development of the invention is in providing a part which is movable against the force of the spring in a longitudinal direction of the ski and functioning as a release plate which preferably has a window therein for indicating the adjusted spring force. This release plate also has a bent section engaging the arms of the sole holder. A draw rod is provided coaxially with respect to the spring with one end thereof being secured to the bent section of the release plate and the other end being rotatably supported in an adjusting screw. With this structure, a purely horizontal release is assured and with a desired constant release force.

BRIEF DESCRIPTION OF THE DRAWINGS

The invention will now be discussed in greater detail with reference to the drawing illustrating one exemplary embodiment.

In the drawing.

DETAILED DESCRIPTION

Figure 1:
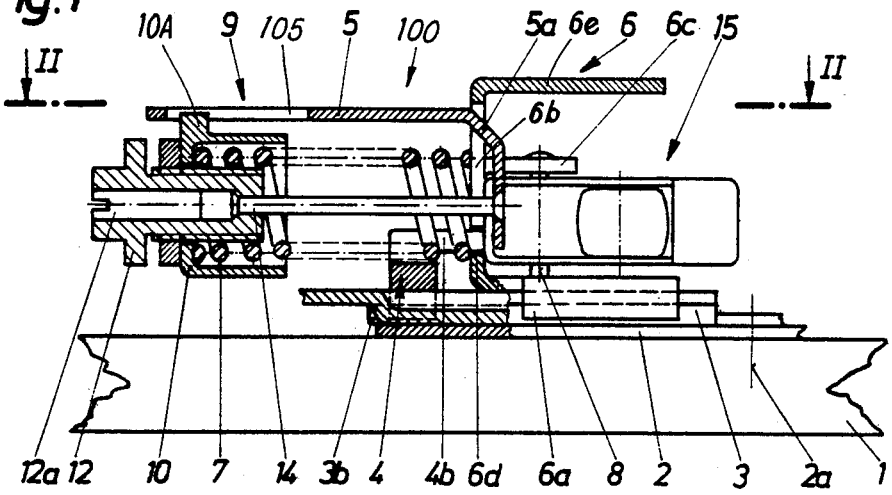
FIG. 1 is a central cross-sectional view taken along the line I—I of FIG. 2 of an inventive jaw.
Figure 3:
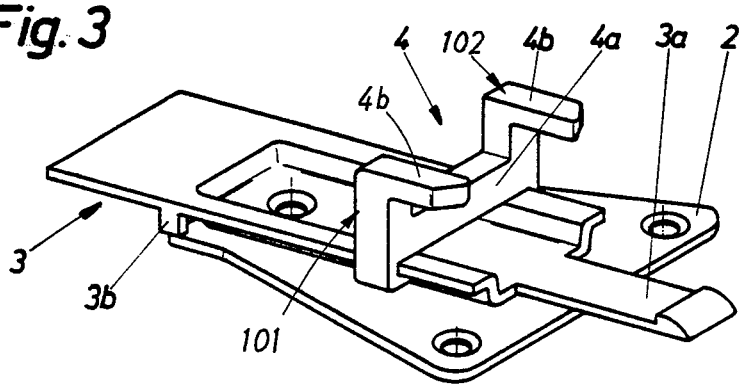
FIG. 3 is a perspective view of an inventive support part of the jaw.

The front jaw 100 has a base plate 2 which is secured to the upper side of a ski 1 by means of screws 2a which are only schematically indicated in FIG. 1. A guide rail 3 is secured to the base plate, for example is screwed or riveted to the base plate 2. The overall shape and design of the guide rail 3 is best illustrated in FIG. 3. The guide rail 3 extends longitudinally of the ski and coextensively with the base plate 2 and is oriented symmetrically with respect to the longitudinal axis of the ski 1. The guide rail has laterally projecting flanges extending upwardly and outwardly in a conventional manner at the lateral edges thereof. The guide rail 3 is provided with a locking tongue 3a at its end remote from the top of the ski, which tongue is engageable with a not illustrated stepping plate. The opposite end region of the guide rail 3 has a pair of stop pins 3b extending downwardly from the outwardly bent part of each flange in a direction toward the upper side of the ski. A support part 4 is slideably disposed on the guide rail 3. More specifically, the support part consists substantially of two right angled parts 101 and 102 connected to one another through a transversely extending web 4a. The upper legs 4b of the angled parts extend parallel with respect to the upper side of the ski and to the longitudinal axis thereof and function as support arms 4b. The support part 4 is engaged at the free ends of the support arms 4b by the sole holders 15 of the jaw in a manner which will yet be described and the other side of the web 4a is engaged by stop pins 3b on the guide rail 3 and is thus secured in a fixed position relative to the ski 1.

A support member 6 is movably guided by means of a support plate 6a on the guide rail 3. A sliding off of the support member 6 from the guide rail 3 in a direction toward the heel holder (not illustrated) of the safety ski binding is for example prevented by the stepping plate which is moved into a locked relationship with the locking tongue 3a on the guide rail 3. The path of movement of the support member 6 in direction toward the tip of the ski (to the left of FIGS. 1 and 2) is limited and corresponds with the distance of the same from the web 4a on the support part 4 when the jaw is in the downhill skiing position. Starting out from the side of the support plate 6a facing the tip of the ski (left side in FIGS. 1 and 2), the support member 6 has an upstanding wall segment 6b which is positioned perpendicularly with respect to the upper side of the ski and has approximately at mid-height thereof a pair of laterally spaced fastening pieces 6c extending parallel with respect to the upper side of the ski. The wall segment 6b transfers over at its upper region into a wall segment 6e which is bent approximately at a right angle to the wall segment 6b for supporting a sole down-holding means which is not illustrated. The sole down-holding means can be swingably supported on a bolt which is also not illustrated and can be adjusted in the elevational direction to adjust the same to different thicknesses in ski shoe soles. This development is actually known and is not part of the subject matter of the present invention.

The two conventionally designed sole holders, which are preferably constructed as toggle levers 15, are swingably supported by means of an upstanding bolt 8 extending perpendicular to the upper side of the ski on the support plate 6a and to the two fastening pieces 6c. The toggle levers 15 each have one arm 15a associated or engageable with a ski shoe sole (not illustrated) and an arm 15b which extends laterally inwardly in a direction toward the longitudinal axis of the ski and engage a bent section 5a of a release plate 5. Furthermore, rollers 13 are rotatably supported on the toggle levers 15, which rollers, as actually known, reduce the sliding friction force which occurs between ski shoe sole and toggle levers 15 during a lateral release. A spring 7 engages at its one end the region of the support member 6, extending perpendicularly with respect to the upper side of the ski, namely, the wall segment 6b. The other end of the spring 7 is supported in a sleeve-shaped spring abutment 10. The initial tension of the spring 7 can be adjusted in a conventional manner by means of an adjusting screw 12. A conventional indicating mechanism 9, which consists substantially of an indicator 10A provided on the spring abutment 10 and extends into a window 105 of the release plate 5, permits a reading of the adjusted spring force.

A draw rod 14 which extends coaxially with respect to the spring 7 is secured at its one end to the bent section 5a of the release plate 5. The other end of the draw rod 14 is held rotatably in a central opening 12a in the adjusting screw 12. Each of the support arms 4b of the support part 4 extend on both lateral sides of the bent section 5a of the release plate 5 through recess 6d in the vertically extending wall segment 6b of the support member 6 and engage on the arms 15b on the toggle levers 15 which in turn engage the bent section 5a of the release plate 5.

OPERATION

The operation of the inventive jaw is very simple. When a force which acts horizontally is applied by a ski shoe (not illustrated) inserted into the binding onto one of the toggle levers 15 the toggle lever 15 swings outwardly about its pivot bolt 8. The toggle lever arm 15b remains engaged with the support arm 4b of the support part 4 which remains stationary (ski-fixed) due to its entrapment between the stops 3b and the support member 6. The support member 6, however, is caused to move on the guide rail 3 in a direction toward the tip of the ski. The release plate 5 together with the draw rod 14, the adjusting screw 12 and the abutment 10 are moved in the opposite direction. Both sequences of movement occur simultaneously compressing to the spring 7, since the spring is supported between the support member 6 and the abutment 10. Also the second toggle lever 15 is swung outwardly. The location of the ideal axis about which each of the toggle levers 15 swings outwardly relative to the ski 1 is determined by the location of the support point on the support surface of the support arms 4b on the toggle lever arms 15b. The positions of these ideal axis do not have any effect on the release operation during a purely horizontally acting force. Following a release of the ski shoe, the toggle levers 15 both return to their initial position under the return force of the spring 7.

Figure 2:
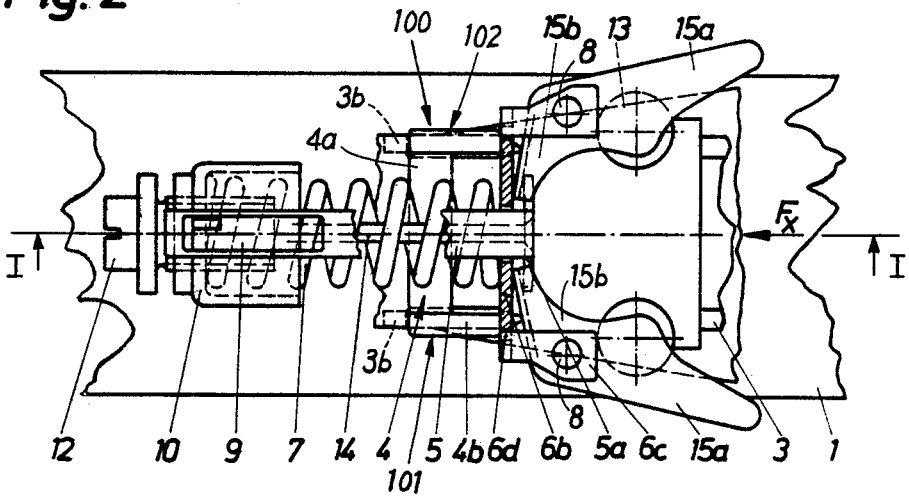
FIG. 2 is a top view of FIG. 1 partially in cross-section and taken along the line II—II of FIG. 1.

If a load is applied to the sole down-holding means (not illustrated) and in a direction toward the tip of the ski, as is indicated in FIG. 2 by the arrow $F_x$, then the support member 6 moves on the guide rail 3 in a direction toward the tip of the ski, and the toggle lever arms 15b which are engaged by the stationary support arms 4b of the support part 4 are both swung outwardly about the axes of the bolts 8 and the release plate 5 is moved into the opposite direction by a compression of the spring 7. In this case, the position of the point of engagement of the support arms 4b with the toggle arms 15b has an effect causing a power component acting in a direction toward the tip of the ski to be absorbed by the spring 7 thereby relieving the force on the toggle levers 15. This position of the points of engagement of the support arms 4b on the toggle lever arms 15b thus determines the degree of translation of a force which acts in a direction toward the tip of the ski onto the spring force. If, for example, the points of engagement lie near the longitudinal axis of the ski, a force which acts in a direction toward the tip of the ski is absorbed substantially by the spring 7 and the toggle levers 15 will be swung outwardly practically force-free. The points of engagement of the support arms 4b on the toggle lever arms 15*b*, which points of engagement remain stationary during operation, determine the ideal pivot axes of the toggle levers 15 relative to the ski 1.

In the case of a forward fall of the skier (twisting fall forwardly), the friction force which occurs between the ski shoe sole and the toggle levers 15 is therefore compensated for and the lateral release force of the jaw remains constant. A further advantage of the inventive jaw consists in a deformation of the ski shoe being prevented when skiing through a depression.

The invention is not limited to the illustrated exemplary embodiments. New modifications are possible without departing from the scope of the invention. Thus it would be possible to fasten the support part also on the base plate or directly on the ski. Also the inventive measures can easily be adapted to a number of existing jaw systems.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a front jaw for a safety ski binding adapted to be mounted on a ski, said jaw including a support member having at least two bolts thereon which are symmetrically arranged with respect to a longitudinal vertical center plane of the jaw and which are substantially perpendicular to the upper side of the ski, each said bolt pivotally supporting a respective sole holder, each said sole holder having a first arm which can engage the sole of a ski shoe and a second arm which extends approximately transversely of the ski and engages a release part, said release part being supported for movement longitudinally of the ski and being biased by a spring, said spring having one end supported on said support member and its other end supported on an abutment which is adjustable longitudinally of the ski relative to said release part by means of an adjusting screw, said support member being supported for movement longitudinally of the ski, the improvement comprising a support part which is supported for movement longitudinally of the ski on a guide rail which is adapted to be secured to and extend longitudinally of the ski, said support part being located on a side of said sole holders nearest the tip of the ski and engaging at least one stop pin which is provided on said guide rail and limits movement of said support part toward the tip of the ski, said support part having two support arms which extend away from the tip of the ski substantially parallel to the upper side of the ski and symmetrically to the longitudinal vertical center plane of the ski, each said support arm having a free end which engages said second arm of a respective one of said sole holders.

2. The jaw according to claim 1, wherein the distance from each of the points of engagement of said support arms of said support part and said second arms of said sole holders to the longitudinal vertical center plane of the ski determines the degree to which a force component which acts onto the sole holders in a direction toward the tip of the ski is translated into a force component which causes said support to move toward the tip of the ski against the urging of said spring.

3. The jaw according to claim 1 wherein said support member has a support plate which is movably supported on said ski-fixed guide rail, said support plate having a portion which extends substantially perpendicular to the upper side of the ski and which supports said one end of said spring, and wherein said portion of said support plate has on each side of the longitudinal vertical center plane of the ski an opening through which a respective one of said support arms of said support part extends.

4. The jaw according to claim 3, wherein said support part is movably supported on said guide rail in a region between said portion of said support plate of said support member and said stop pin on said guide rail.

5. The jaw according to claim 1, wherein said release part which is biased by said spring in a direction longitudinally of the ski includes a release plate which has a bent section which engages said second arms of said sole-holders, wherein said spring is helical, and wherein coaxially within said helical spring there is provided a draw rod, one end of which is secured to said bent section of said release plate and the other end of which rotatably supports said adjusting screw.

6. In a front jaw for a safety ski binding adapted to be mounted on a ski, said front jaw having a pair of symmetrically arranged two-arm sole holders supported for pivotal movement about respective axles which are perpendicular to the upper side of the ski and are supported on a support member which is supported for movement longitudinally of the ski on a guide rail, said guide rail being adapted to be secured to the ski, each said sole holder having a first arm which can engage a ski shoe and a second arm which engages one side of a slide member which is supported for movement longitudinally of the ski and is biased by a helical spring, said slide member being secured to one end of a draw rod which is arranged coaxially within said spring, wherein said spring has one end supported on an upright wall segment of said support member and has its other end supported on an abutment which is positionally adjustable relative to said draw rod by means of an adjusting screw, the improvement comprising wherein said upright wall segment of said support member has two openings therethrough; wherein said jaw includes a support part which is fixed against movement relative to the ski in a direction toward the tip thereof, which is located on a side of said upright wall segment remote from said sole holders, and which has two projections thereon which each extend through a respective said opening in said upright wall segment; and wherein said second arm of each said sole holder is engaged on a side thereof remote from said slide member by the free end of a respective one of said projections provided on said support part.

7. The jaw according to claim 6, wherein said support part is movably supported on said guide rail and engages on a side thereof remote from said sole holders at least one stop pin which is provided on said guide rail, said stop pin extending substantially vertically.

8. The jaw according to claim 6 or 7, wherein said projections on said support part extend parallel to the upper side of the ski and are symmetrically arranged with respect to a longitudinal vertical center plane of the ski, wherein said free ends of said projections which engage said second sole holder arms have one of a sloped shape and a rounded shape, and wherein the distance from each of the points of engagement of said projections of said support part and said second sole-holder arms to the longitudinal vertical center plane of the ski is relatively small.

9. The jaw according to claim 7, wherein said support member has a web and is movably supported on said guide rail in a region between said upright wall segment on said support member and said stop pin on said guide rail, and wherein said web has said projections thereon.

10. A safety ski binding jaw which is adapted to be mounted on a ski, comprising: a guide arrangement which can be secured to the ski; a support member which is supported on said guide arrangement for movement longitudinally of the ski; two sole holders supported on said support member for pivotal movement about respective, spaced, generally vertical axes, each said sole holder having first and second arms, said first arms being adapted to engage a ski boot and said second arms extending inwardly toward each other in directions generally transverse to the ski; resilient means cooperable with said sole holders for yieldably urging pivotal movement of each said sole holder in a first direction corresponding to movement of said second arm thereof in a direction toward the tip of the ski; and means on said support member for limiting pivotal movement of said sole holders in said first direction; said guide arrangement including a projection which engages said second arm of at least one said sole holder at a location thereon spaced from said pivot axis thereof.

11. The ski binding jaw according to claim 10, wherein said guide arrangement includes two said projections, each said projection engaging said second arm of a respective one of said sole holders.

12. The ski binding jaw of claim 11, wherein said guide arrangement includes a guide rail which is adapted to be secured to the ski, a support part having a web portion which is supported on said guide rail for movement longitudinally of the ski, and stop means provided on said guide rail and cooperable with said support part for limiting movement of said support part toward the tip of the ski, said support member being movably supported on said guide rail at a location spaced from said support part and on the side of said support part remote from the tip of the ski, said support part including two laterally spaced support arms provided on said web portion thereof and extending away from the tip of the ski, each said support arm having a free end which is remote from said web portion and engages said second arm of a respective one of said sole holders, said support arms being said projections of said guide arrangement.

13. The ski binding jaw according to claim 12, wherein said means for limiting pivotal movement of said sole holders includes said support member having a generally upright wall portion on a side of said sole holders nearest the tip of the ski, said wall portion being engageable with said second arm on each said sole holder and having two laterally spaced openings therethrough, each said support arm of said support part extending through a respective said opening in said upright wall portion.

14. The ski binding jaw according to claim 13, wherein said resilient means includes an elongate draw member which is supported for movement longitudinally of the ski and has a first end which is closer to the tip of the ski than a second end thereof, said first and second ends thereof being located on opposite sides of said upright wall portion and said second end engaging each of said second arms of said sole holders on a side thereof opposite said upright wall portion; and wherein said resilient means includes means supporting an abutment near said first end of said draw member for positional adjustment therealong in directions longitudinal of the ski and a compression spring which extends between and has its ends respectively supported on said abutment and said upright wall portion.

* * * * *